US007278395B2

(12) United States Patent
Amend et al.

(10) Patent No.: US 7,278,395 B2
(45) Date of Patent: Oct. 9, 2007

(54) MANUALLY OPERATED IMPLEMENT DRIVEN BY AN INTERNAL COMBUSTION ENGINE

(75) Inventors: Helmar Amend, Waiblingen (DE); Klaus-Martin Uhl, Plochingen (DE); Sebastian Friedrich, Korb (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/314,401

(22) Filed: Dec. 21, 2005

(65) Prior Publication Data

US 2006/0137653 A1 Jun. 29, 2006

(30) Foreign Application Priority Data

Dec. 22, 2004 (DE) ..... 10 2004 061 723

(51) Int. Cl.
*F02D 11/04* (2006.01)

(52) U.S. Cl. ..... 123/400; 123/179.18

(58) Field of Classification Search ..... 123/179.18, 123/400; 30/381, 382; 74/532
See application file for complete search history.

(56) References Cited

U.S. PATENT DOCUMENTS 2,818,147 A * 12/1957 Mall et al. ..... 123/363
2,829,537 A * 4/1958 Mall et al. ..... 74/532
3,314,405 A * 4/1967 Irgens ..... 123/376
3,353,525 A * 11/1967 Nutten et al. ..... 123/339.1
4,028,804 A * 6/1977 Hammond ..... 30/382
4,406,066 A 9/1983 Itzrodt ..... 30/382
4,672,929 A * 6/1987 Wissmann et al. ..... 123/179.18
5,212,886 A * 5/1993 Tasaki ..... 30/381
5,827,455 A * 10/1998 Nakai ..... 123/179.18
6,328,288 B1 12/2001 Gerhardy ..... 261/35
2004/0035394 A1 2/2004 Gerhardy ..... 123/400

* cited by examiner

*Primary Examiner*—T. M. Argenbright
(74) *Attorney, Agent, or Firm*—Robert W. Becker; Robert W. Becker & Associates

(57) ABSTRACT

A manually guided implement driven by an internal combustion engine having a carburetor that is actuated by a throttle lever arrangement, which includes a throttle lever that is mounted in the implement so as to be pivotable about a pivot axis, and also includes a transmission element that operatively connects the throttle lever with the carburetor. The transmission element is an essentially rigid connecting rod that is mounted on the throttle lever and on an actuating lever of the carburetor.

13 Claims, 3 Drawing Sheets

MANUALLY OPERATED IMPLEMENT DRIVEN BY AN INTERNAL COMBUSTION ENGINE

The instant application should be granted the priority date of Dec. 22, 2004 the filing date of the corresponding German patent application 10 2004 061 723.6.

The invention relates to a manually operated implement driven by an internal combustion engine.

Manually operated implements such as parting-off grinders, chain saws, etc. of known construction have a throttle lever mounted in the implement in such a manner that it is able to pivot and which acts upon the carburetor in the drive engine by means of a transmission element. The throttle lever is generally positioned in a handle and can be actuated by a finger when a hand is clasped around this handle. The transmission element provided is a Bowden cable which transmits the movement of the throttle lever to an actuating lever in the carburetor, which in turn adjusts the pivot position of the throttle valve in the carburetor.

A carburetor for the internal combustion engine in a manually operated implement is known from DE 199 18 719 A1. The carburetor disclosed in this specification takes the form of a double-flow carburetor for a two-stroke engine operating with stratified scavenging. Positioned downstream of a venturi section into which fuel is taken for mixture formation is a pivoting throttle valve by means of which the volume of the flow of fuel/air mixture can be adjusted in order to control power output. An air duct for airhead scavenging is positioned so that it runs parallel to the intake duct by means of which fuel-free air is fed into the drive engine. The air duct has its own throttle valve which is linked to the throttle valve in the intake duct for the fuel/air mixture.

The lever coupling between the two throttle valves comprises a groove in one of the levers in which the transmission rod between the two throttle valve levers is held with longitudinal play. The throttle valve in the intake duct is opened from the idle throttle position until the transmission rod comes to rest on the end of the groove. When the throttle valve in the intake duct is opened further from this half throttle position, the throttle valve in the air duct is also opened due to the action of the transmission rod. In the lower load range the internal combustion engine is supplied only with the fuel/air mix from the intake duct. The supply of fuel-free air is suppressed in order to prevent the engine from dying when the throttle is opened due to the mixture becoming leaner. Not until the upper load range does the second throttle valve release the flow of fuel-free air.

To start the internal combustion engine, particularly in the case of a warm start, it is desirable to set the throttle valve in the intake duct to a slightly open position without opening the throttle valve in the air duct at the same time. The aim is to open the first throttle valve to a point just before which the second throttle valve in the air duct opens.

Previously known throttle lever arrangements with a pivoting throttle lever and a transmission element in the form of a Bowden cable present an undesirably high level of play. Furthermore, a certain elasticity of the transmission train can also be observed, adding to the undesirable level of play notably at the increased actuating forces operating in a double-flow carburetor. Bowden cables are also prone to contamination which can lead to increased friction forces, wear-induced elongation and the "wandering" of the throttle valve position in relation to the throttle lever position after only a short operating time. Accurate throttle valve adjustment in the carburetor is difficult, particular during starting.

The object of the invention is to develop a manually operated implement of the aforementioned general type in such a manner that the accuracy of carburetor actuation in improved.

The invention proposes a manually operated implement driven by an internal combustion engine having a throttle lever arrangement provided for the actuation of a carburetor of the internal combustion engine and which comprises a throttle lever mounted in the implement in such a manner that it is able to pivot about an axis of pivot and also comprises a transmission element which forms an active connection between the throttle lever and the carburetor. The transmission element is an essentially rigid connecting rod mounted on the throttle lever and on an actuating lever of the carburetor. In this context the term connecting rod means that a pulling force is transmitted from the throttle lever to the actuating lever when the throttle valve is opened. The rod is essentially rigid at an angle to the direction of pull. The throttle valve which is spring pre-tensioned in the direction of closing puts the throttle lever arrangement under an initial pulling tension which eliminates any bearing play, etc. The actuation of the throttle lever and the resulting transmission of the pulling force to the actuating lever of the carburetor and thus to the throttle valve actuated thereby, is essentially without play. The rigid design of the transmission element as a rod also avoids elastic deformations. Practically no frictional forces occur. There is also a precisely defined correlation between throttle lever position and throttle valve position.

In an advantageous development the axis of pivot of the throttle lever is positioned on a rear end of the throttle lever in relation to the usual working position of the implement. The pivoting front end on which the connecting rod is mounted is thus able to project into the inside of the implement. This produces a short, direct and undisturbed transmission path between throttle lever and carburetor. In particular, the connecting rod runs essentially in a straight line, thereby reducing minor residual elasticity to a minimum. Even at high actuating forces such as those occurring in double-flow carburetors the movement of the throttle lever is transmitted in a precisely defined manner.

In an advantageous design, an actuating section of the throttle lever lies between the axis of pivot and a bearing point of the connecting rod on the throttle lever. The resulting lever kinematics mean that the bearing point of the connecting rod covers a larger distance than the finger of an operator positioned on the actuating section. In relation to an actuating path of the actuating section touched by the user predetermined by the design, the increased actuating path of the connecting rod means that the absolute value of an unavoidable residual value of elasticity and play represents a proportionally reduced part of the increased path of travel. The accuracy of the transmission is further increased.

In connection with the arrangement of a switch element described in greater detail below, a significant advantage of the design lies in the immediate proximity of the point of engagement of the switch element and the throttle lever to the bearing point of the connecting rod on the throttle lever. The position of the bearing point is thus influenced primarily by the locking lug on the switch element. In this manner, the effects of any tolerance-related positional deviation of the axis of pivot of the throttle lever and of any geometrical deviation of the throttle lever on the position of the bearing point of the connecting rod can be minimized. Negative influences on the lever kinematics such as an increase in positional deviation, for example, are thus avoided.

In an expedient embodiment the throttle lever extends essentially in a longitudinal direction running at an angle to the axis of pivot, the connecting rod running at an angle and in particular approximately perpendicular to the longitudinal direction and to the axis of pivot. The kinematics of this system mean that the direction of actuation of the connecting rod runs parallel to the direction of movement of the actuating finger. By avoiding changes in direction, the overall essentially right-angled nature of the arrangement contributes to the directness of the transmission movement.

The throttle lever end of the connecting rod is advantageously bent at right angles and clipped into a bearing recess in the throttle lever. The bearing recess and the bent end of the connecting rod form an easy to mount, essentially play- and friction-free pivoting bearing which can be fitted easily without implements. The clip connection can be slightly pre-tensioned, thereby avoiding the occurrence of residual play.

In an advantageous development a switch element acting directly on the throttle lever is positioned in a component acting as a bearing for the throttle lever and in particular in the handle of the implement, the switch element being provided to fix the throttle lever in a starting throttle position. The mounting of the throttle lever and the switch element in the same component, preferably in the handle, results in their precise orientation in relation to one another. The actuation of the switch element fixes the throttle lever accurately in a starting throttle position which is transmitted accurately and without losses to the carburetor by means of the connecting rod described above. In association with double- or multi-flow carburetors, in particular, it is therefore possible to set the desired starting throttle position accurately without the undesirable need to partially open the additional air valve. This guarantees the reliable starting of the engine.

The throttle lever expediently has an angled face, the switch element being provided with a switch projection which slides along the angled face when the switch element is actuated and consequently lifts the throttle lever from an idle throttle position into a starting throttle position. Using the principle of the oblique plane, the throttle lever can be lifted into the desired position without play. If the material is selected appropriately the frictional forces generated are low. Actuation is easy and exact.

The angled face advantageously runs into a locking recess which is provided to receive the switch projection. The pulling tension on the connecting rod automatically engages the locking recess on the throttle lever side with the switch projection and without further intervention sets the throttle lever into the predetermined design position where it remains during the starting process without the lever arrangement having to be held at the same time.

The switch element and the throttle lever are usefully positioned in such a manner in relation to one another that when the throttle valve is in the idle throttle position and the switch element is actuated from its idle position, the switch projection automatically moves to rest on the angled face. With one single movement, namely the actuation of the switch element, the throttle lever is moved into the desired starting position. No additional, independent actuation of the throttle lever is required. It is simply necessary to actuate a throttle lever lock. However, this is effected automatically since as the user takes hold of the handle to actuate the switch element, he or she also depresses the throttle lever lock.

The switch element may be a sliding element, push button, or similar device and is advantageously designed as a pivoting control lever. Such an arrangement is well protected against dirt, wear-resistant and low in friction.

In an advantageous version the switch element is spring pre-tensioned in the direction of its idle position. Once starting has been successfully completed, the throttle lever need simply be lifted slightly by hand, the locking recess on the throttle lever thereby releasing the switch projection on the control lever. The switch element moves back to its idle position automatically. Normal operation with actuation of the throttle lever can then commence without further intervention.

An embodiment of the invention is described in greater detail below with reference to the accompanying schematic drawings, in which.

Figure 1:
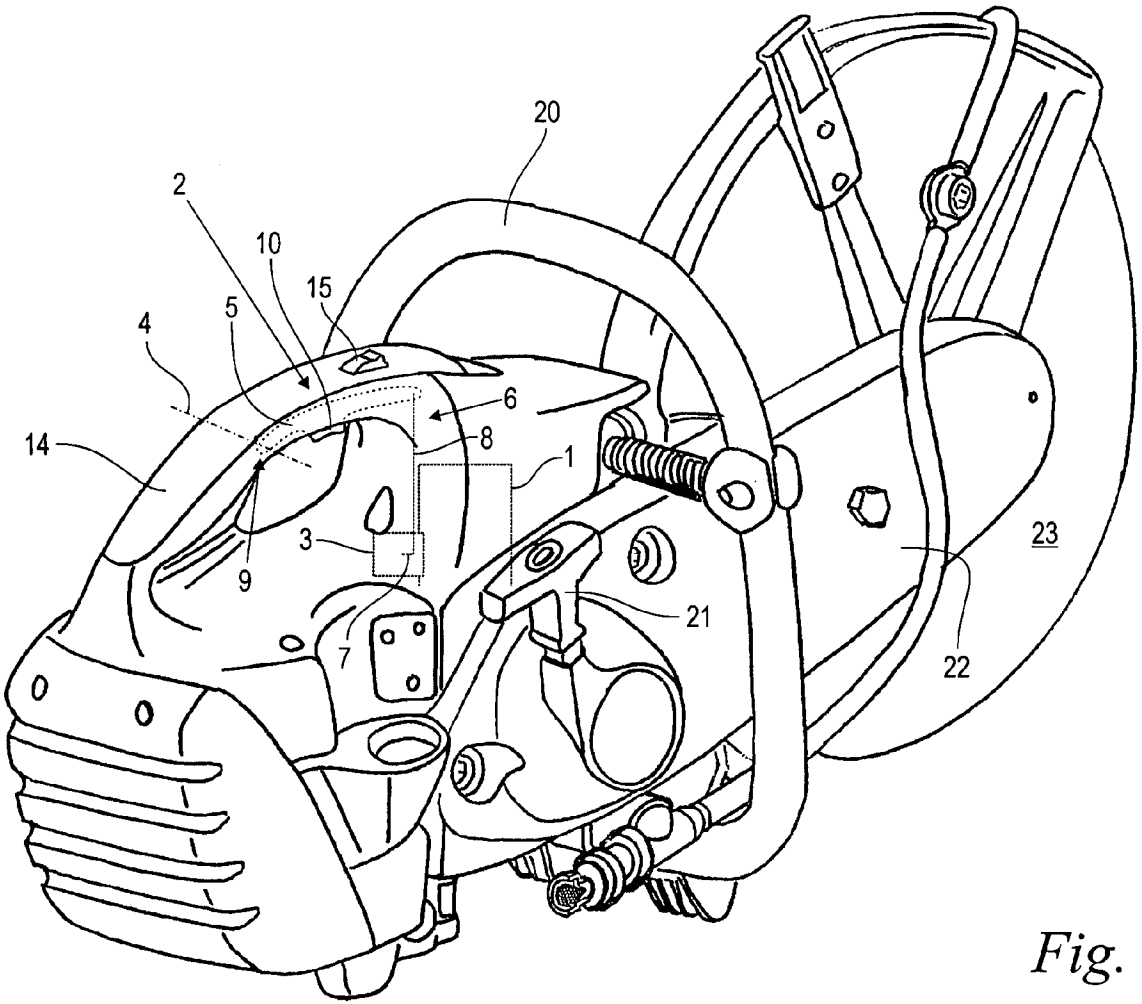
FIG. 1 shows a perspective view of a manually operated implement based on the example of a parting-off grinder driven by an internal combustion engine with an outline view of the throttle lever arrangement disclosed in the invention.

FIG. 1 gives a general perspective view of a manually operated implement based on the example of a parting-off grinder or cut-off machine driven by an internal combustion engine. It may also be a chain saw or similar device. The parting-off grinder has a rotating parting-off wheel 23 which is driven by means of a schematically illustrated internal combustion engine 1 located in a housing of the parting-off grinder. The internal combustion engine 1 drives the parting-off wheel 23 by means of a belt drive 22. A cable pull starter 21 is mounted on the side of the parting-off grinder for starting the internal combustion engine 1. During operation the parting-off grinder is held and guided by means of a rear handle 14 and a front handle 20. The rear handle is mounted at an angle behind and above the internal combustion engine 1 and the housing surrounding it. This arrangement is referred to as a "top handle".

Figure 2:
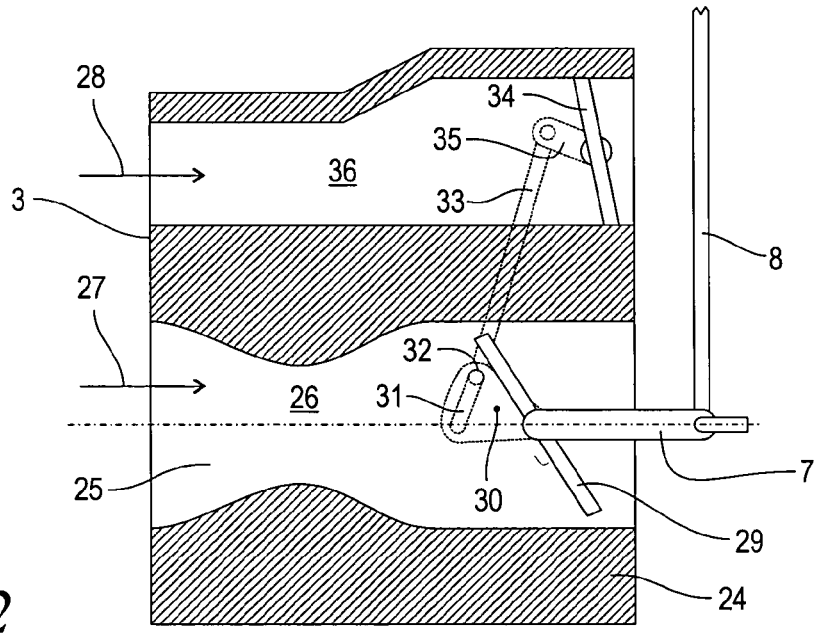
FIG. 2 shows a schematic view in longitudinal section of the kinematics of a double-flow carburetor in the implement illustrated in FIG. 1.

A schematically illustrated carburetor 3 is provided to supply a fuel/air mixture to the internal combustion engine 1, said carburetor 3 having a throttle valve 29 illustrated in FIG. 2 which can be adjusted by means of an actuating lever 7. In order to do this a throttle lever 5 is mounted in the rear handle 14 in such a manner that it is able to pivot about a pivot axis 4. The throttle lever 5 can also be fitted in a pivoting mount in a housing section or the like of the implement. In relation to the normal working position of the parting-off grinder illustrated, the pivot axis 4 lies at the rear end 9 of the throttle lever 5. Mounted at the opposing, front end of the throttle lever 5 is a transmission element 6 which forms an operative connection between the throttle lever 5 and the actuating lever 7 of the carburetor 3. The transmission element 6 takes the form of an essentially rigid connecting rod 8 and is described in greater detail below.

The throttle lever 5 and the connecting rod 8 run essentially completely inside the implement housing or the handle 14. Only an approximately centrally positioned actuating section 10 of the throttle lever 5 projects from the underside of the handle 14 so that it can be moved into the desired throttle position by the fingers of an actuating hand. Provided on the upper side of the handle 14 is a switch element 15 by means of which the throttle lever 5 can be fixed in a starting throttle position.

The carburetor 3 indicated in FIG. 1 is shown in a schematic view in longitudinal section in FIG. 2. In the embodiment illustrated the carburetor 3 takes the form of a double-flow carburetor with an intake duct 25 and a separate air duct 36. A single- or multi-flow carburetor design may also be useful. During operation, the internal combustion engine 1 (FIG. 1) takes in combustion air through the intake duct 25 along the line of the arrow 27. In a subsequent, narrowed venturi section 26 the underpressure created causes fuel to be taken in and a fuel/air mixture to be formed which is then supplied to the internal combustion engine 1 in the direction of the arrow 27. In order to control the volume of the flow of fuel/air mixture and thus the power output of the internal combustion engine 1 (FIG. 1), there is mounted in the intake duct 25 in such a manner that it is able to pivot a throttle or butterfly valve 29, the position of which can be adjusted by means of the actuating lever 7. Mounted at the free end of the actuating lever 7 is the connecting rod 8. When the connecting rod 8 is pulled, the throttle valve 29 is pivoted in the direction of opening against the pre-tensioning force of a spring not illustrated. When the pulling load on the connecting rod 8 is eased off, the throttle valve 29 pivots automatically back into its approximately closed idle throttle position.

The throttle valve 29 is shown in a partially open position which is selected for starting the internal combustion engine 1 (FIG. 1).

The additional air duct 36 through which fuel-free or fuel-low fresh air can be taken in, in the direction of the arrow 28, is provided for the mid and upper load ranges. In order to control the flow of fresh air a further throttle valve 34 is provided in the air duct 36 which is coupled to the position of the throttle valve 29 by means of first and second transmission levers 30, 35 and a transmission rod 33. The first transmission lever 30, which can be pivoted together with the actuating lever 7 and the throttle valve 29, is provided with a groove 31 in which the relevant end of the transmission rod 33 is mounted. From the closed, idle throttle position of the throttle valve 29 not illustrated to the part load or warm start position of the throttle valve 29 shown here, the groove 31 slides over the associated end of the transmission rod 33 without actuating either it or the throttle valve 34 in the air duct 36 which is connected to it. The throttle valve 34 is closed; the supply of air through the air duct 36 is suppressed.

When the throttle valve 29 is opened further, the associated end of the transmission rod 33 hits one end 32 of the groove in the first transmission lever 30, thereby applying a pulling force to the transmission rod 33. This pulling force is transmitted by means of the second transmission lever 35 to the throttle valve 34 which is then pivoted into an open position. Airhead scavenging then commences in the internal combustion engine 1 FIG. 1 in the known manner with an additional supply of fresh air.

In order to ensure the reliable starting of the internal combustion engine 1 illustrated in FIG. 1, it is desirable to achieve a carburetor position in which the throttle valve 29 in the intake duct 25 is pivoted into the partially open starting position illustrated here. This is dimensioned such that the transmission rod 33 lies immediately adjacent to the end 32 of the groove, but without causing the throttle valve 34 of the air duct 36 to start opening. It is desirable to set a relative valve position such as that illustrated in FIG. 3 by means of the transmission rod 33 as precisely as possible.

Figure 3:
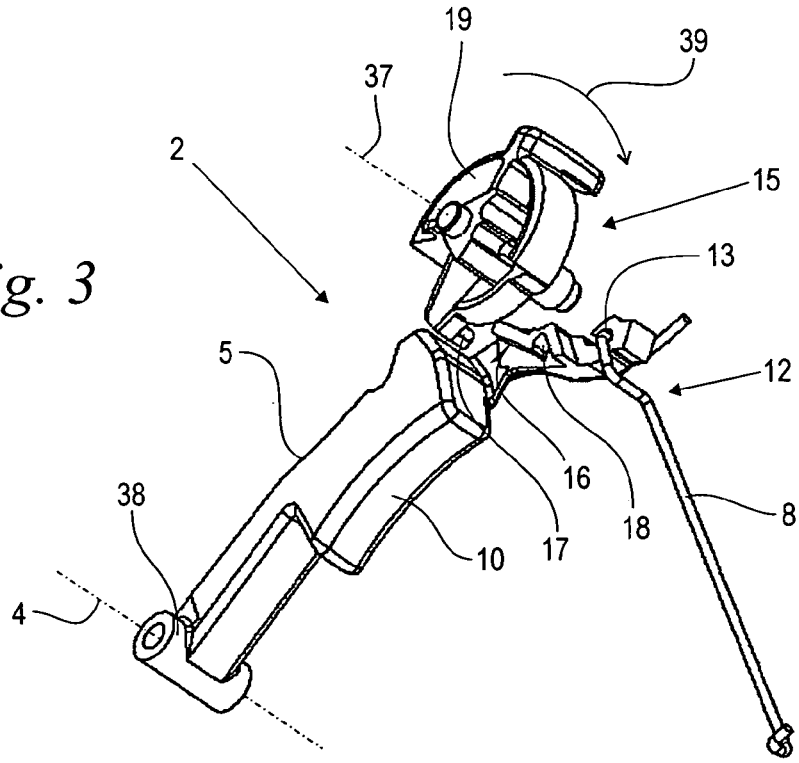
FIG. 3 shows a perspective detailed view of the relative positions of the throttle lever, the control lever and the connecting rod in the arrangement illustrated in FIG. 1.

FIG. 3 shows a general perspective view of individual details of the throttle lever arrangement 2 as illustrated in FIG. 2. The throttle lever 5 takes the form of a plastic injection molded part with a formed bearing sleeve 38 in the area of the rear pivot axis 4. In the center of the throttle lever 5 the actuating section 10 projects inwardly and downwardly. Provided on the end of the throttle lever 5 opposite the pivot axis 4 is a bearing or mounting recess 13 in which is mounted the end 12 of the connecting rod 8 on the throttle lever 5 side. In order to achieve this, the connecting rod 8 is bent at right angles in this area to form the corresponding bearing. For the rest, in the embodiment illustrated it runs in a straight line.

The mount for the throttle lever 5 shown in FIG. 1 with the rear pivot axis 4 and the front bearing recess 13 shown in FIG. 3, together with the design of the implement with a top handle 14, permits the connecting rod 8 to run in a straight line from the bearing recess 13 to the actuating lever 7 of the carburetor 3 (FIG. 1). Alternatively, depending on the spatial construction of the implement, an angled design of the connecting rod may be useful, its design as an essentially rigid rod continuing to permit the transmission of pulling forces from the throttle lever 5 to the actuating lever 7 of the carburetor 2.

Part of the throttle lever arrangement 2 indicated in FIG. 1 and shown in detail in FIG. 3 is the switch element 15 which is provided to fix the throttle lever 5 in a starting throttle position. The switch element 15 may be a sliding switch, push button or similar device and in the embodiment shown is a control lever 19 which can be pivoted about a pivot axis 37. The control lever 19 is pre-tensioned by means of a spring not illustrated in the direction indicated by the arrow 39 and thus towards the idle position shown here. On the radial side facing the throttle lever 5 the control lever 19 has a switch projection 17 which projects on an axis parallel to the pivot axis 37. In the immediate vicinity of the switching projection 17, in the area between the actuating section 10 and the bearing recess 13, the throttle lever 5 is provided with an angled face 16 which projects approximately in the direction of the pivot axis 37. The angled face 16 rises against the downward arrow 39 in relation to a pivoting movement of the switch projection 17 and runs in this direction into a locking recess 18.

The control lever 19 and the throttle lever 5 are positioned in relation to one another in such a manner that when the control lever 19 is actuated against the direction of the arrow 39, the switch projection 17 is brought from the idle position of the throttle lever 5 and the control lever 19 shown into contact with the angled face 16, and in the course of the further pivoting movement slides along the angled face 16 until the switch projection 17 covers the locking recess 18. The sliding of the switch projection or nose 17 along the angled face 16 causes the throttle lever 5 to pivot and lift about the pivot axis 4 until the locking recess 18 on the throttle lever 5 is pulled onto the switch projection 17 due to the effect of the pulling force on the connecting rod 8. Lifting the throttle lever 5 from its idle position as shown does not require the exertion of pressure on the actuating section. It is effected by the pivoting of the control lever 19 as already described alone.

Figure 4:
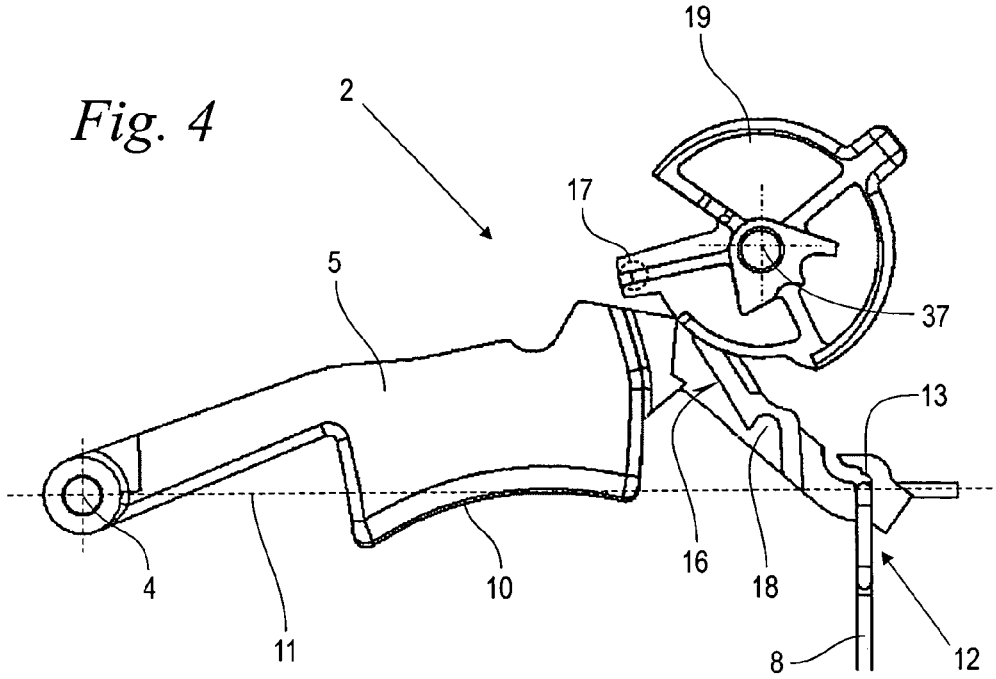
FIG. 4 shows a side view of the arrangement illustrated in FIG. 3 with the control lever in the idle position and the throttle lever in the idle throttle position.

FIG. 4 shows a side view of the throttle lever arrangement as illustrated in FIG. 3. It is evident that the throttle lever 5 is an essentially elongated lever component which extends in a longitudinal direction 11. In relation to said longitudinal direction 11 the actuating section 10 is positioned approximately centrally between the axis of pivot 4 and the bearing recess 13 opposite the axis of pivot 4. The connecting rod 8, the throttle lever end 12 of which is mounted in the bearing recess 13, runs approximately perpendicular to the longitudinal direction 11 and also to the axis of pivot 4. A different relative arrangement of the pivot axis 4, the actuating section 10, the bearing recess 13 and the connecting rod 8, with different angles or a different sequence of components, for example, may also be useful.

The throttle lever 5 is shown in its idle throttle position in which the bearing recess 13 and thus the connecting rod 8 are lowered such that the throttle valve 29 illustrated in FIG. 2 is pivoted into the approximately fully closed idle throttle position not illustrated in FIG. 2. The control lever 19, which can be pivoted about the axis of pivot 37, is also shown in its idle position, the switch projection 17 lying at a distance from the angled face 16. The angled face 16 is positioned such that it lies on the course described by the switch projection 17 when the control lever 19 is pivoted about the axis of pivot 37.

In this case the switch projection 17 hits the angled face 16 which runs at an oblique angle to the course described by the switch projection 17. Due to a further pivoting movement against the direction of the arrow 39 FIG. 5, the switch projection 17 slides down the angled face 16 which effects the lifting and pivoting of the throttle lever 5 about the axis of pivot 4 following the principle of the oblique plane. The bearing recess 13 is lifted in a corresponding manner and exerts a pulling movement on the connecting rod 8.

Figure 5:
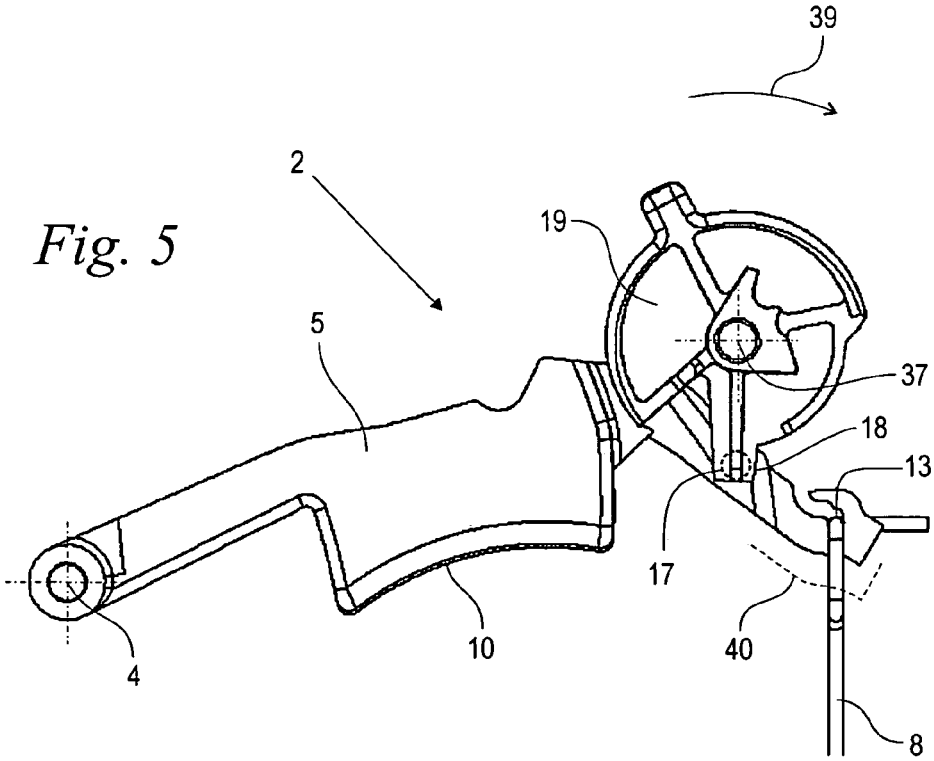
FIG. 5 shows the arrangement illustrated in FIG. 4 with the switch element and the throttle lever in the starting throttle position.

FIG. 5 shows the arrangement illustrated in FIG. 4 in the aforementioned lifted position, showing the lifted position of the area of the bearing recess 13 in contrast to the idle position illustrated in FIG. 4 and indicated here by means of a broken line 40. Via the actuating lever 7, the throttle valve 29 FIG. 2 which is pre-tensioned in the direction of its closed position exerts a pulling tension on the connecting rod 8 which pulls the bearing recess 13 in the direction of the broken line 40. In this arrangement the locking recess 18 illustrated more clearly in FIG. 4 is pressed against the switch projection 17. The throttle lever 5 and the control lever 19 as well as the throttle valve arrangement illustrated in FIG. 2 are in the warm start position.

The spring pre-tensioning of the control lever 19 in the direction of pivoting indicated by the arrow 39 not shown in greater detail causes the switch projection 17 to come out of the locking recess 18 when the internal combustion engine 1 is started and when the throttle lever 5 is actuated for the first time. The control lever 19 is able to move back into the idle position illustrated in FIG. 4 automatically due to its spring pre-tensioning in the direction of the arrow 39.

In the embodiment illustrated the throttle lever arrangement 2 is provided with an angled face 16 on the throttle lever 5. It may also be useful to have an angled face on the control lever 19 with a corresponding switch projection 17 on the throttle lever 5, thereby creating the reverse effect. Instead of the arrangement of a single locking recess 18 shown, it is also possible to provide several locking devices in a row which permit different carburetor settings together with an additional choke valve, for example.

The specification incorporates by reference the disclosure of German priority document DE 10 2004 061 723.6 filed Dec. 22, 2004.

The present invention is, of course, in no way restricted to the specific disclosure of the specification and drawings, but also encompasses any modifications within the scope of the appended claims.

The invention claimed is:

1. A manually guided implement driven by an internal combustion engine having a carburetor, comprising:

a throttle lever arrangement for actuating said carburetor, wherein said throttle lever arrangement includes a throttle lever that is mounted in said implement so as to be pivotable about a pivot axis, and also includes a transmission element that operatively connects said throttle lever with said carburetor, wherein said transmission element is an essentially rigid connecting rod that is mounted on said throttle lever and on an actuating lever of said carburetor, wherein a switch element that acts directly upon said throttle lever is disposed in a component of said implement that serves as a mount for said throttle lever, and wherein said switch element is provided for a fixing of said throttle lever in a starting throttle position.

2. An implement according to claim 1, wherein said pivot axis is disposed on a rearward end of said throttle lever as viewed in a normal operating position of said implement.

3. An implement according to claim 1, wherein said connecting rod extends essentially linearly.

4. An implement according to claim 1, wherein an actuating section of said throttle lever is disposed between said pivot axis and a bearing point of said throttle lever for said connecting rod.

5. An implement according to claim 1, wherein said throttle lever extends essentially along a longitudinal direction that extends transverse to said pivot axis, and wherein said connecting rod extends transverse to said longitudinal direction and to said pivot axis.

6. An implement according to claim 5, wherein said connecting rod extends approximately perpendicular to said longitudinal direction and to said pivot axis.

7. An implement according to claim 1, wherein an end of said connecting rod facing said throttle lever is bent off at an angle and is adapted to be clipped into a mounting recess of said throttle lever.

8. An implement according to claim 1, wherein said switch element is disposed in a handle of said implement.

9. An implement according to claim 1, wherein said throttle lever is provided with an angled face, and wherein said switch element is provided with a switch projection that upon actuation of said switch element slides along said angled face thereby lifting said throttle lever out of an idling position into said staffing throttle position.

10. An implement according to claim 9, wherein said angled face leads into a locking recess that is provided for accommodating said switch projection.

11. An implement according to claim 9, wherein said switch element and said throttle lever are positioned relative to one another such that when said throttle lever is in said idling position, and said switch element is moved out of its rest position, said switch projection comes into contact with said angled face.

12. An implement according to claim 1, wherein said switch element is embodied as a pivotable control lever.

13. An implement according to claim 1, wherein said switch element is spring biased in a direction toward its rest position.

* * * * *